US008333341B2

(12) United States Patent
Long et al.

(10) Patent No.: US 8,333,341 B2
(45) Date of Patent: Dec. 18, 2012

(54) REEL WITH DRUM CENTER SUPPORT RING

(75) Inventors: Richard Long, Hartselle, AL (US); John Womack, Hartselle, AL (US); Henry Henderson, Jefferson, TX (US); Charles Ball, Hartselle, AL (US)

(73) Assignee: Sonoco Development Inc., Hartsville, SC (US)

( * ) Notice: Subject to any disclaimer, the term of this patent is extended or adjusted under 35 U.S.C. 154(b) by 0 days.

(21) Appl. No.: 12/487,845

(22) Filed: Jun. 19, 2009

(65) Prior Publication Data

US 2010/0320311 A1 Dec. 23, 2010

(51) Int. Cl.
*B65H 75/14* (2006.01)
*B65H 75/18* (2006.01)

(52) U.S. Cl. ..... 242/613.4

(58) Field of Classification Search ..... 242/613.4, 242/613.5, 613, 118.31, 609.2, 608.4, 600, 242/607, 608, 608.2, 608.3, 609, 609.1, 610, 242/118.32, 118.4, 118.6, 118.7
See application file for complete search history.

(56) References Cited

U.S. PATENT DOCUMENTS

| | | | | |
|---|---|---|---|---|
| 1,984,738 | A * | 12/1934 | Gleason | 242/118.6 |
| 2,856,137 | A * | 10/1958 | Howsam | 242/118.7 |
| 3,446,455 | A * | 5/1969 | Starratt | 242/118.8 |
| 4,451,013 | A * | 5/1984 | Bedrosian | 242/118.4 |
| 4,471,919 | A * | 9/1984 | Leunig | 242/608.2 |
| 6,959,892 | B2 * | 11/2005 | Sanda | 242/608.8 |
| 2003/0189128 | A1 * | 10/2003 | Soepnel et al. | 242/608.4 |

FOREIGN PATENT DOCUMENTS

GB 347168 A * 4/1931

OTHER PUBLICATIONS

Sheet Metal Gage Thickness Table (http://academic.evergreen.edu/projects/biophysics/technotes/fabric/sheet_metal.htm).*

* cited by examiner

*Primary Examiner* — William E Dondero
(74) *Attorney, Agent, or Firm* — Womble Carlyle Sandridge & Rice, LLP

(57) ABSTRACT

A wooden cable reel has a drum made of a plurality of staves and flanges secured at the ends of the drum. A steel support ring is rolled from a strip to have a diameter corresponding to the interior diameter of the drum and the ends of the strip are welded together. The support ring extends around the interior of the drum intermediate its ends and is secured to the drum from the inside by fasteners extending through the ring and into the interior surface of the drum. The support ring resists inwardly directed forces applied to the drum when cable is wound onto the reel and thus prevents the drum from deforming or collapsing.

17 Claims, 2 Drawing Sheets

REEL WITH DRUM CENTER SUPPORT RING

TECHNICAL FIELD

This disclosure relates generally to reels and more specifically to wooden cable reels upon which large quantities of wire or cable may be wound.

BACKGROUND

Wire and cable such as that used in the electrical power and communications industries has long been wound onto large cable reels for storage and transport. While some cable reels are made of metal, others are made of wood. Wooden cable reels typically include a central cylindrical drum secured to disc-shaped flanges at its ends. The central drum traditionally is made of elongated wooden staves that have an arcuate cross-section and that are assembled side-by-side to form the cylindrical shape of the drum. The ends of the staves are usually received in annular routes formed in the inside surfaces of the flanges, and a plurality of subheads may be disposed around the interior of the routes to provide extra support for the ends of the drum. When all of the staves are assembled with their ends disposed in the routes of the flanges, long metal bolts are extended through holes in the flanges and nuts are threaded onto one or both of their ends and tightened to hold the flanges securely against the ends of the drum and thus to hold the cable reel together.

When wire or cable (or some other product) is wound helically around the reel drum of a cable reel, a tremendous amount of radially inwardly directed force or pressure can be asserted on the drum, which must be born by the staves of the drum. For longer cable reels, this can result in an inward bowing of the drum at its center, or even in failure of one or more of the drum staves. Accordingly, one or more center supports may be installed within the drum to provide supplemental support for the central regions of the staves and thus the drum. Traditionally, a cable reel center support has consisted of a wooden or plywood disc disposed within the drum between its ends and having a diameter equal to the interior diameter of the drum. During construction of the cable reel, the staves that form the drum are assembled around the center support disc and are secured thereto with fasteners, such as nails or screws, extending through the staves and into the peripheral edge of the disc. The disc also may be toe nailed in place from the outside of the drum or held in place by nailing, screwing, or blocking on the interior of the drum. When the flanges are secured to the ends of the drum, the center support disc provides radial support to the drum between its ends to resist the pressures and forces generated when cable is wound onto the cable reel. In some cases, more than one support disc may be used.

While traditional center support discs provide adequate central support to drums of cable reels, they nevertheless have demonstrated certain problems and shortcomings. For example, they are relatively time consuming and thus expensive to construct from wood and the installation of a center support disc within the drum can be complicated and labor intensive. Further, the disc can come loose or get out of place after the reel is loaded and no longer provide support. This can result in problems unloading the reel, or even complete collapse of the reel. Perhaps more significantly, however, the fasteners that hold center support disc within the drum have been known to loosen and back out under the pressures and stresses endured by cable reels. This, in turn, has been known to damage cable wound onto the cable reel and even to render portions of the cable unusable. This can be a significant issue since tens of thousands of dollars worth of cable can easily be stored on a single wooden cable reel. Finally, while cable reel recycling programs exist, it has been found that the wooden center support discs of cable reels do not always survive in sufficient condition to be re-used, and thus are discarded.

Accordingly, a need exists for a method and apparatus for providing radial central support to cable reel drums that, among other things, addresses the problems and shortcomings of traditional center support discs. More specifically, the apparatus should be economical, provide for easy assembly compared to support discs, and be virtually completely recyclable. There should be no fasteners positioned to back out or become loose in such a way that they can damage cable wound onto the cable reel during storage, transport, and use. It is to the provision of such an apparatus and method that the present disclosure is primarily directed.

SUMMARY

Briefly described, a cable reel has an elongated cylindrical drum and a pair of larger diameter disc-shaped flanges secured at the ends of the drum. In one embodiment, the drum is made of a plurality of side-by-side wooden staves having curved cross sections with their ends extending into annular routes milled in the flanges. The cable reel is held securely together with long bolts that extend through the flanges and through the interior of the drum adjacent its inner surface. A center support ring, which preferably is made of rolled and welded steel, has an outer diameter that is substantially the same as the inner diameter of the drum and extends around the inside of the drum at a central location. The center support ring is secured to the interior of the drum with fasteners, such as screws, that extend through the support ring and into the interior surface of the drum.

In use, cable is wound around the drum and onto the cable reel. During this process, large inwardly directed forces are imparted to the drum and thus to the center support ring extending around the interior of the drum. Since these forces are applied substantially evenly around the drum, the support ring resists the forces and exerts an outwardly directed support force around the center of the drum. This support force, in turn, counterbalances the inward forces generated by the cable and prevents the drum from deforming or collapsing. Thus, the support ring provides central support to the drum with results comparable to prior art center supports. However, unlike these other center supports, the support ring does not extend into the central portion of the drum, is virtually completely recyclable and reusable, and can be made from scrap metal produced in related or unrelated operations. Perhaps most significantly, however, all of the fasteners that hold the ring to the staves of the drum are on the inside of the drum rather than on the outside. Thus, there are no fasteners to back out in such a way that they can damage cable or other product wound onto the drum. Also, a reel fabricated according to the present disclosure requires less wood to carry the same amount of cable and is thus more eco-friendly than prior art reels.

These and other feathers, aspects, and advantages of the invention will become more apparent upon review of the detailed description set forth below taken in conjunction with the accompanying drawing figures, which are briefly described as follows.

DETAILED DESCRIPTION

Figure 1:
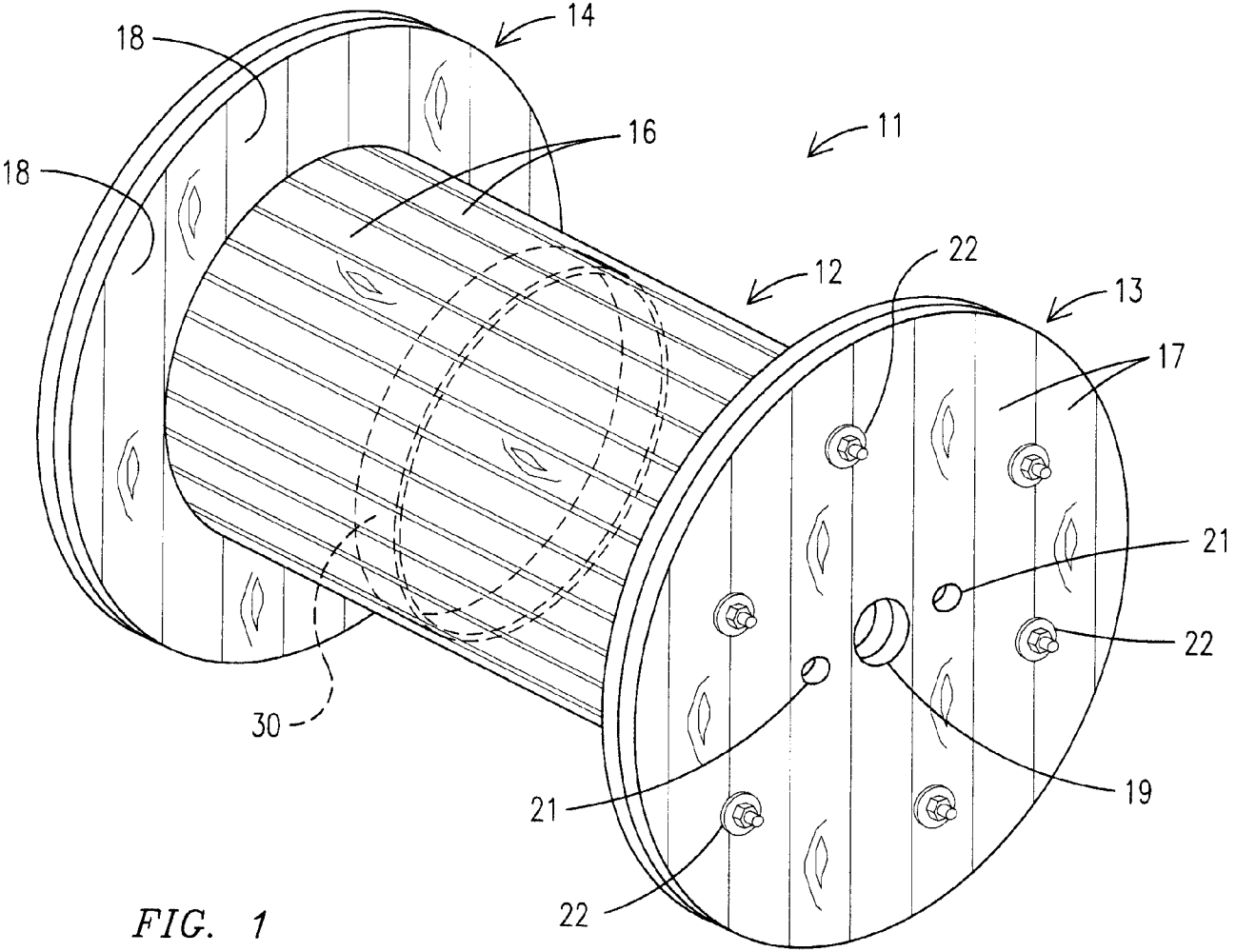
FIG. 1 is a perspective view of a cable reel that embodies principles of the disclosure in a preferred form.

Referring now in more detail to the drawing figures, wherein like reference numerals refer to like parts throughout the several views, FIG. 1 illustrates a typical cable reel 11 with which the center support ring of this disclosure can be employed. In the illustrated and preferred embodiments, the cable reel is made of wood; however, this is not a limitation of the invention and reels made of other materials such as metal and plastic also may be reinforced with a center support ring as described herein. The cable reel 11 has a cylindrical drum 12 with first and second flanges 13 and 14 respectively secured to the ends of the drum 12 to define the shape of the reel. The drum in the illustrated embodiment is formed by a plurality of wooden staves 16 arranged in side-by-side relationship. The staves preferably are milled with an arcuate cross section so that their outer surfaces together define a relatively smooth curved surface of the drum. The flanges 13 and 14 may be constructed of two or more layers of side-by-side flange boards with the boards of each layer extending in a different direction than those of the adjacent layer. In FIG. 1, the outside flange boards of the flanges are designated with reference numeral 17 while the inside flange boards are designated with reference numeral 18. The flange boards can be secured together in any appropriate way such as, for instance, with adhesive, staples, nails, screws, or combinations, as is known in the art.

The flanges 13 and 14 are secured to the ends of the drum 12 by a plurality of steel bolts 23 (FIG. 2) that extend through the interior of the drum 12 and that have appropriate washers and nuts 22 threaded securely on their protruding ends. The flanges include a central spindle hole 19 and may include two or more auxiliary holes 21 to accommodate winding, unwinding, and storage equipment as necessary. A center support ring 30 has an outer diameter that corresponds to the inner diameter of the drum 12 and extends around the interior of the drum at a location intermediate its ends. As discussed in detail below, the support ring 30 preferably is made of steel that has been rolled into a ring and welded at its ends, although other materials and constructions are possible. The support ring 30 is secured to the drum with fasteners, such as screws, that extend through the support ring 30 and into the interior surface of the drum. In this way, there are no fasteners to back out through the outside surface of the drum to damage cable products wound onto the reel.

Figure 2:
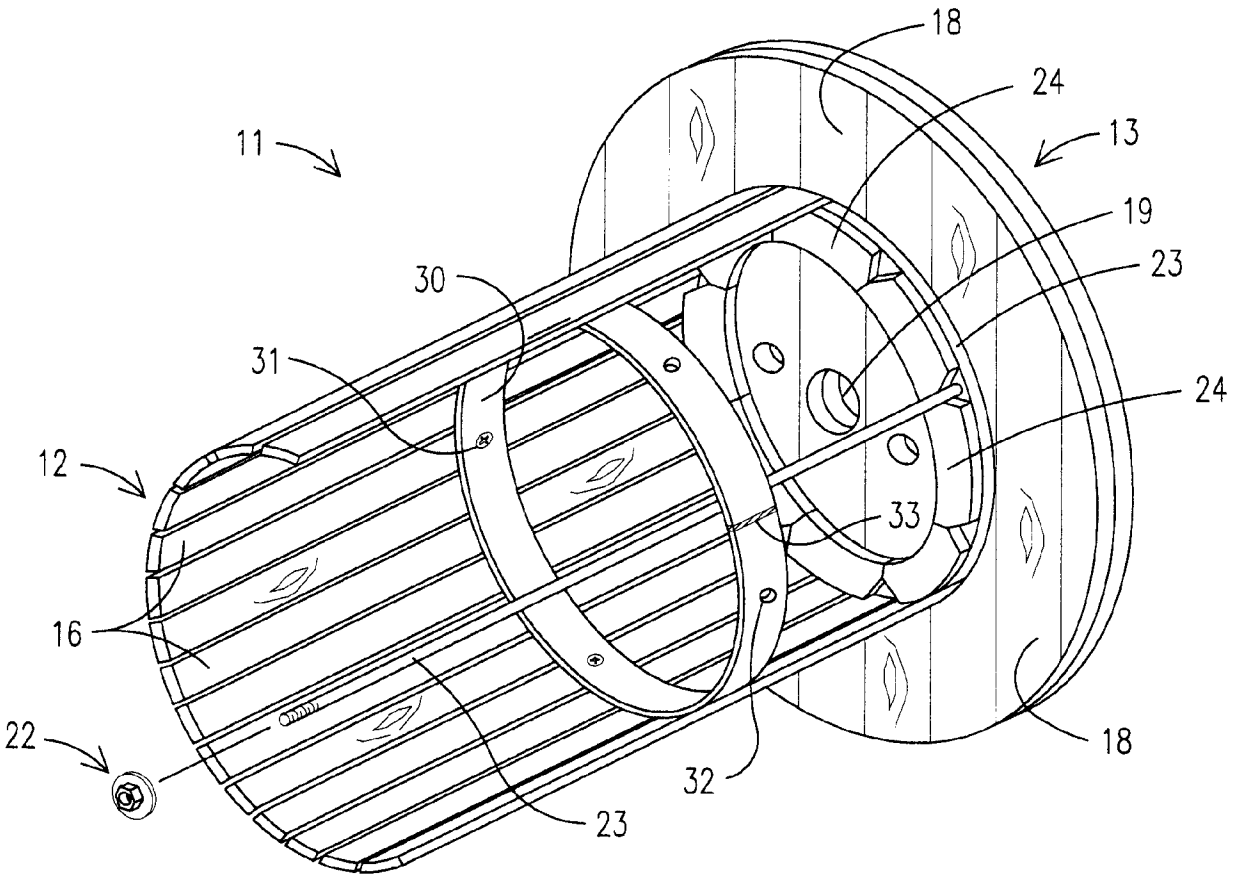
FIG. 2 is a view of the cable reel partially completed with one flange removed for clarity and illustrating an internal center support ring according to the disclosure.

FIG. 2 illustrates the construction of the reel 11 in more detail by showing the reel in a partially assembled state with the flange 14 removed for clarity of illustration. The flange 13 is milled to provide a concentric annular route 23 sized to received the ends of the side-by-side drum staves 16. A plurality of blocks referred to as subheads 24 may be fixed to the inside surface of the flange 13. The subheads 24 have an arcuate edge that aligns with the interior edge of the route 23 to provide additional support to the ends of the staves 16. Bolts 23 (only one of which is shown in FIG. 2) extend through the drum 12 from one flange to the other and washers and nuts 22 are threadable onto at least one end of each bolt. When the reel is constructed, the nuts are tightened onto the bolts to draw the flanges together and hold them tightly to the ends of the drum 12. The bolts 23 and washers and nuts 22 thus secure the reel 11 together and the routes 23 and subheads 24 secure and position the ends of the drum staves 16.

The center support ring 30 extends around the interior surface of the drum 12. The support ring 30 preferably is formed of a strip of steel that is rolled to the proper diameter with its ends being welded together as indicated by reference numeral 33. Attachment holes 32 may be formed in the center support ring 30 to receive fasteners 31 that extend through the support ring 30 and are secured to the staves 16 on the interior of the drum. As mentioned above, this attachment technique avoids a significant issue with prior art center supports in that all of the fasteners are on the inside of the drum and are not positioned so that they can back out and damage product wound onto the reel.

It has been found that the center support ring 30 is best formed of steel and more specifically a steel strip having a gauge of 16 or less, and more preferably a gauge of 14 or less, that is rolled to the proper diameter with its ends being welded together to form a continuous ring. The width of the support ring 30 can vary between about 1.5 and 4 inches. Both the gauge of the steel and the width of the ring can be varied as needed depending upon the desired load capacity to be provided by the ring. It has further been found that the support ring 30 can be formed of scrap metal, thus further reducing the cost of the ring.

It should be understood that while a ring formed of a strip of steel as discussed above is preferred, other ring configurations and fabrication techniques may be substituted with equivalent results. For instance, the ring may be made of a material other than steel such as, for instance, aluminum, carbon fiber technology, or composites. Further, the ring need not be flat or rectangular in cross section but may take on other cross sectional shapes such as, for example, elliptical, round, D-shaped, H-shaped like an I beam, combinations thereof, or any other shape that provides the needed support. Finally, the support ring need not be rolled, but may be formed by alternate techniques such as casting, injection molding, thermal forming, or any other suitable fabrication methods. Accordingly, the term "ring" as used herein and in the claims is not limited to the configuration of the ring shown in the drawings and presented as the preferred embodiment, but is intended to be sufficiently broad to cover the forgoing and any other alternative configurations of a support ring.

Various methods of construction may be employed to construct the reel 11 according to this disclosure. For example, the drum staves 16 can be assembled around the center support ring and around the subheads of the flanges with the ring being progressively secured to the staves with screws. The bolts and nuts can then be tightened to draw the ends of the staves into the routs and hold the reel securely together. Regardless of construction technique, when the reel 11 is completed and cable or other product is wound with tension helically around the drum, large forces and pressures are asserted on the drum in a radially inward direction. Since these forces are generally uniformly distributed around the circumference of the drum, they are also applied uniformly around the support ring 30. While a ring can be deformed relatively easily with unequal application of radial force, very large forces can be tolerated by a ring when the forces are uniformly distributed around the ring as in the present case. Thus, the support ring 30 resists the inward forces applied to the drum by the cable and provides a counterforce directed radially outwardly that supports the central portion of the drum and prevents its deformation or collapse. The center support ring also is highly unlikely to be displaced or to come loose from the inside of the drum as can prior art center supports because it is screwed to the inside of the drum and because it can be much wider that a prior art center support disc with correspondingly more area in contact with the inside of the drum.

When cable reels are worn out, they sometimes are refurbished or recycled. As mentioned above, prior art center supports often do not survive in sufficient condition to be reused, and must be discarded. However, with the center support ring of the present disclosure, the support ring 30 survives and can be removed from a used cable reel without damage and thus is virtually always reusable in a new or recycled cable reel. Further, use of a center support ring as disclosed allows less wood to be used in a reel that carries the same amount of cable as a prior art reel. The support ring of this disclosure is therefore eco-friendly as well as economical.

The invention has been described herein in terms of preferred embodiments considered by the inventors to represent the best mode of carrying out the invention. However, a wide range of additions, deletions, and modifications might be made to the illustrated embodiments within the scope of the invention. For example, while the invention has been exemplified within the context of a wood reel, it also may be applicable to reels made of plastic, metal, a composite, or any other material. Further, although steel has been illustrated as the best material from which to form the center support ring, other materials such as aluminum, plastics, composites, and other resilient formable material may be used. While screws are the preferred method of attaching the support ring to the interior of the drum, other fasteners such as nails, staples, clips, or even adhesives might be used with satisfactory results. Finally, the particular configuration of the reel shown in the drawing figures is exemplary only and the invention is not limited to any specific reel construction or configuration. These and other modifications might well be made to the preferred embodiments illustrated and discussed herein without departing from the spirit and scope of the invention, which is delineated only by the claims.

What is claimed is:

1. A cable reel comprising:

a generally cylindrical drum having an axis, an interior surface, an exterior surface, and ends;

a first flange secured at one end of the cylindrical drum;

a second flange secured at the other end of the cylindrical drum; and a ring extending around the interior surface of the drum at a location intermediate the ends of the drum to support the drum against inward forces generated when a cable or wire product is wound onto the reel;

wherein the ring is spaced from a central portion of the drum so as to not extend into the central portion of the drum, and has an outer diameter that substantially corresponds to an inner diameter of the drum, and has a width extending parallel to the axis of the drum and a thickness extending perpendicular to the interior surface of the drum, with the width of the ring being at least five times the thickness of the ring;

the ring being substantially rigid and continuous throughout its extent to exert outwardly directed support forces in response to the inward forces applied to the cylindrical drum by winding of the cable or wire product about the drum.

2. The reel of claim 1 and wherein the ring is fastened to the interior surface of the drum.

3. The reel of claim 2 and wherein the ring is fastened with fasteners that extend through the ring and partially into the drum.

4. The reel of claim 3 and wherein the fasteners are screws.

5. The reel of claim 1 and wherein the first and second flanges are made at least partially of wood.

6. The reel of claim 1 and wherein the drum is made at least partially of wood.

7. The reel of claim 6 and wherein the drum is formed by a plurality of staves arranged in side-by-side relationship.

8. The reel of claim 7 and wherein the ring is secured to the staves.

9. The reel of claim 8 and wherein the ring is secured with fasteners that extend through the ring and partially into at least some of the staves.

10. The reel of claim 1 and wherein the ring is made of metal.

11. The reel of claim 10 and wherein the metal is steel.

12. The reel of claim 11 and wherein the steel has a gauge of 16 or less.

13. The reel of claim 1 and wherein the ring has a width of between about 1.5 inches and about 4 inches.

14. The reel of claim 1 and wherein the ring is made of metal having a gauge of 16 or less and a width between about 1.5 inches and about 4 inches.

15. A reel as claimed in claim 1 and wherein the ring is formed of a strip of material rolled to a predetermined diameter with its ends being welded together to form the continuous configuration of the ring.

16. A reel as claimed in claim 15 and wherein the ring is formed of metal.

17. A reel as claimed in claim 16 and wherein the metal is steel.

* * * * *